US006341664B1

(12) United States Patent
Gerber

(10) Patent No.: US 6,341,664 B1
(45) Date of Patent: Jan. 29, 2002

(54) EXHAUST MUFFLER WITH STAMP FORMED INTERNAL ASSEMBLY

(75) Inventor: James E. Gerber, Clayton, NC (US)

(73) Assignee: Goerlich's Inc., Goldsboro, NC (US)

( * ) Notice: Subject to any disclaimer, the term of this patent is extended or adjusted under 35 U.S.C. 154(b) by 0 days.

(21) Appl. No.: 09/482,776

(22) Filed: Jan. 13, 2000

(51) Int. Cl.[7] ..... F01N 7/18
(52) U.S. Cl. ..... 181/282; 181/272; 181/276
(58) Field of Search ..... 181/282, 272, 181/276, 243, 270, 255, 257

(56) References Cited

U.S. PATENT DOCUMENTS

| | | | |
|---|---|---|---|
| 705,357 A | | 7/1902 | Keating |
| 1,110,040 A | | 9/1914 | Chatain |
| 2,484,826 A | | 10/1949 | Harley |
| 2,484,827 A | | 10/1949 | Harley |
| 2,658,580 A | | 11/1953 | Trembley |
| 2,860,722 A | | 11/1958 | Gerstung |
| 2,902,109 A | | 9/1959 | Burgess et al. |
| 2,943,695 A | | 7/1960 | Jeffords |
| 3,125,182 A | | 3/1964 | Earley |
| 3,140,755 A | | 7/1964 | Tranel |
| 3,158,222 A | | 11/1964 | Richmond |
| 3,176,791 A | | 4/1965 | Betts et al. |
| 3,198,284 A | | 8/1965 | Powers |
| 3,220,508 A | | 11/1965 | Nordquest et al. |
| 3,386,529 A | | 6/1968 | Pannone |
| 3,412,825 A | | 11/1968 | Hall |
| 3,638,756 A | | 2/1972 | Thiele |
| 3,650,354 A | | 3/1972 | Gordon |
| 3,709,320 A | | 1/1973 | Hollerl et al. |
| 3,827,529 A | | 8/1974 | Frietzsche et al. |
| 3,852,041 A | | 12/1974 | Moore et al. |
| 4,064,962 A | | 12/1977 | Hunt |
| 4,108,274 A | | 8/1978 | Snyder |
| 4,109,751 A | | 8/1978 | Kabele |
| 4,132,286 A | | 1/1979 | Hasui et al. |
| 4,165,798 A | | 8/1979 | Martinez |
| 4,252,212 A | * | 2/1981 | Meier ..... 181/252 |
| 4,279,326 A | | 7/1981 | Meineke et al. |
| 4,396,090 A | | 8/1983 | Wolfhugel |

(List continued on next page.)

FOREIGN PATENT DOCUMENTS

| | | |
|---|---|---|
| GB | 632013 | 11/1949 |
| GB | 1012463 | 12/1965 |
| GB | 2120318 A | 11/1983 |
| JP | 59-43456 | 3/1984 |
| JP | 59-155528 | 9/1984 |
| JP | 60-111011 | 6/1985 |
| JP | 61-14565 | 1/1986 |
| JP | 61-108821 | 5/1986 |

*Primary Examiner*—Khanh Dang
(74) *Attorney, Agent, or Firm*—George Pappas

(57) ABSTRACT

A muffler including an internal assembly formed of a pair of identical stampings. The internal assembly includes three tubes extending longitudinally between baffles. The internal assembly received within the muffler outer shell forms central upper and lower attenuation chambers as well as chambers at each proximal end of the muffler. The stampings are provided with impressions for forming weep holes and allowing acidic condensation to exit the central chambers. The stampings are located in mirror image relation with one another and are attached to one another by a rivet pattern and using the metal of the stampings. The rivets readily allow acidic condensate to flow between the upper and lower central chambers. Louver-shaped openings are provided on the stampings providing communication between the formed tubes and the upper and lower central chambers and thereby providing attenuation. The muffler is generally universal for use on many different exhaust engines and vehicles and is generally corrosion resistant and generally long lasting.

24 Claims, 5 Drawing Sheets

U.S. PATENT DOCUMENTS

| | | | | | |
|---|---|---|---|---|---|
| 4,415,059 | A | | 11/1983 | Hayashi | |
| 4,418,790 | A | | 12/1983 | Agnew | |
| 4,422,519 | A | | 12/1983 | Nomura et al. | |
| 4,456,091 | A | | 6/1984 | Blanchot | |
| 4,475,623 | A | | 10/1984 | Gerber | |
| 4,486,932 | A | | 12/1984 | Hall | |
| 4,516,659 | A | | 5/1985 | Hall | |
| 4,523,660 | A | | 6/1985 | Gaddi | |
| 4,598,709 | A | | 7/1986 | Uesugui et al. | |
| 4,635,752 | A | | 1/1987 | Jennings | |
| 4,690,245 | A | | 9/1987 | Gregorich et al. | |
| 4,700,806 | A | | 10/1987 | Harwood | |
| 4,736,817 | A | | 4/1988 | Harwood | |
| 4,759,423 | A | | 7/1988 | Harwood et al. | |
| 4,760,894 | A | | 8/1988 | Harwood et al. | |
| 4,765,437 | A | | 8/1988 | Harwood et al. | |
| 4,809,812 | A | | 3/1989 | Flugger | |
| 4,821,840 | A | | 4/1989 | Harwood et al. | |
| 4,836,330 | A | | 6/1989 | Harwood et al. | |
| 4,847,965 | A | | 7/1989 | Harwood et al. | |
| 4,860,853 | A | | 8/1989 | Moring, III | |
| 4,894,987 | A | | 1/1990 | Harwood et al. | |
| 4,901,815 | A | | 2/1990 | Harwood et al. | |
| 4,901,816 | A | | 2/1990 | Garey | |
| 4,905,791 | A | | 3/1990 | Garey | |
| 4,909,348 | A | | 3/1990 | Harwood et al. | |
| 4,928,372 | A | | 5/1990 | Harwood et al. | |
| 4,941,545 | A | | 7/1990 | Wilcox et al. | |
| 5,004,069 | A | | 4/1991 | Van Blaircum | |
| 5,012,891 | A | | 5/1991 | Macaluso | |
| 5,042,125 | A | | 8/1991 | Harwood et al. | |
| 5,164,551 | A | | 11/1992 | Harwood et al. | |
| 5,173,577 | A | | 12/1992 | Clegg et al. | |
| 5,252,788 | A | | 10/1993 | Emrick et al. | |
| 5,563,383 | A | * | 10/1996 | Harwood | 181/282 |
| 5,563,385 | A | * | 10/1996 | Harwood | 181/282 |
| 5,581,056 | A | * | 12/1996 | Bellgardt et al. | 181/282 |
| 5,597,986 | A | * | 1/1997 | Harwood et al. | 181/282 |
| 5,717,173 | A | | 2/1998 | Gerber et al. | |
| 5,816,361 | A | | 10/1998 | Gerber | |
| 6,135,237 | A | * | 10/2000 | Allman | 181/282 |

* cited by examiner

EXHAUST MUFFLER WITH STAMP FORMED INTERNAL ASSEMBLY

TECHNICAL FIELD

The subject invention relates to vehicular exhaust mufflers having an outer shell surrounding a stamp formed internal assembly and end caps and inlet and exhaust tubes at opposed ends of the outer shell. More particularly, the subject invention is directed to an improved stamp formed internal assembly for decreasing manufacturing costs and increasing the muffler useful life.

BACKGROUND OF THE INVENTION

Vehicular mufflers are today very commonly constructed using stamp formed sheet metal outer shells as well as internal assemblies. The internal assemblies quite often incorporate and form baffles, exhaust tubes and other components utilized in attenuating and decreasing the apparent sound generated by the vehicle engine. By stamp forming, the various muffler component parts manufacturing costs can be significantly decreased. Several such mufflers which have been constructed using various stamp formed component parts are, for example, shown and described in Gerber, U.S. Pat. No. 5,816,361, Gerber et al., U.S. Pat. No. 5,717, 173, Wilcox, et al., U.S. Pat. No. 4,941,545 and Wolfhugel, U.S. Pat. No. 4,396,090.

The Gerber, U.S. Pat. No. 5,816,361, for example, discloses a muffler constructed with a tubular outer shell and end caps attached thereto at each end thereof An internal cartridge or assembly is provided and constructed of stamp formed component parts. These assemblies or cartridges are constructed using two identical stamp formed plates which have been placed in mirror relation with respect to one another forming baffles at each end thereof and tubes extending therebetween. Each of the tubes include perforations. Although this muffler and the stamp formed assembly therein provide for a generally inexpensive means of manufacturing, it has shortcoming and drawbacks. For example, the stamp formed plates are assembled by spot welding and, as a consequence, the coating of the sheet metal as well as the sheet metal itself is weakened thereat thereby causing premature deterioration thereof by the acidic water which typically condenses within the muffler. Additionally, this condensate of acidic water is not readily removed from the central chambers between the baffles causing accumulation thereof and furthering premature deterioration of the stamp formed plates and assembly. Further yet, most prior mufflers tend to be limited in their application to only certain vehicles or with only certain exhaust engines.

Accordingly, a need exists for a muffler constructed using stamp formed sheet metal component parts which decreases manufacturing costs and which is more resistant to deterioration and which is, further, more universal for use on different vehicles and exhaust engines.

SUMMARY OF THE INVENTION

It is the principal object of the present invention to overcome the above-discussed disadvantages associated with prior mufflers constructed using stamp formed sheet metal components. The present invention overcomes the disadvantages associated with prior mufflers by providing a muffler having a tubular outer shell and end caps connected to opposed ends thereof. A pair of stampings or stamp formed sheet metal plates are connected to each other in a face to face relationship and forming an assembly which includes a least three tubes extending between baffles. The sheet metal stampings are identical to one another and are also located in mirror image relation with respect to one another for forming the assembly. The assembly is received within the muffler outer shell and an inlet tube extends through one of the end caps and communicates with one of the assembly tubes. At the other end of the muffler, an outlet tube extends through that end cap and communicates with another one of the assembly tubes. As constructed, the assembly baffles divide the volume within the outer shell for providing a first chamber between the muffler inlet end and a baffle, a second chamber between the outlet end and the other baffle and a central chamber between the baffles. Preferably, the stampings portions forming the assembly between the baffles extend to the inner surface of the outer shell thereby dividing the central chamber into upper and lower central chambers.

Each of the stampings or plates include baffle portions at opposing ends and further include valley portions and semicircular portions extending longitudinally between the baffle end portions. The valley portions are located between the semicircular portions so that, when the stampings are located in mirror image relation and face to face to one another with the valley portions of one stamping located adjacent the valley portion of the other stamping and the semicircular portions of one stamping located adjacent the semicircular portions of the other stamping, the resultant assembly includes longitudinally extending tubes formed by the semicircular portions extending between the end baffle portions.

The sheet metal stampings or plates are attached to one another by rivets which are provided at the valley portions of the stampings. Preferably, the stampings are provided with alternating rivet holes and annular protrusions in each of the stamping valley portions such that, when two stampings are placed in mirror image relation with respect to one another and face to face, the annular protrusions of one stamping are received within the rivet holes of the other stamping. After the stampings are place in mirror image relation with respect to one another and with the annular protrusions of one of the stampings extending through the rivet holes of the other stamping, the annular protrusions are deformed radially outwardly thereby clamping or fixedly attaching the stampings together thereat. With this rivet type attachment, the protective coating of the sheet metal is not damaged or otherwise compromised except for the cut surfaces of the rivet holes and annular protrusions. Additionally, the deforming or bending over of the sheet metal over the rivet holes further reinforces the attachment providing additional mass unlike, for example, spot welding.

So as to further decrease deterioration of the stampings and increase the life of the muffler, each of the baffles are provided with an impression whereby, upon insertion of the assembly within the outer shell and locating the baffles therein, the impressions form weep holes between the upper and lower chambers and the first and second chambers. Thus, the acidic water which condenses within the upper and lower central chambers readily and easily exits through these weep holes and to the first or second chambers wherefrom the water can be expelled through a hole provided in the muffler outer shell or end cap. By only providing an impression along the outer edge of the stamping portion which forms the baffle, the sheet metal coating is again not removed or otherwise compromised thereby preventing rapid deterioration thereof and lengthening the life of the muffler.

The muffler is further improved by providing a design which is substantially more universal and usable on different vehicles and exhaust engines. In this regard, each of the assembly tubes are provided with one or more rows of openings for providing communication between the assembly tubes and the upper and lower central chambers. The openings are louver shaped and, preferably, one-half of the row of louvers open longitudinally generally toward the inlet end of the muffler and the other one-half of the row of louvers open generally longitudinally in the opposite direction toward the exhaust end of the muffler. It has been found that, most preferably, two rows of louvers identical to the first and wherein each row includes ten louver shaped openings, five of which open in the direction of the inlet end and the other five opening in appositive direction toward the exhaust end, advantageously cause exhaust noise to be attenuated in the upper and lower central chambers for many different vehicles and exhaust engines. Yet more preferably, each of the two rows of louver shaped openings are located on each stamping semicircular portion less than forty-five degrees radially from each other around the semicircular portion which forms the assembly tubes.

In one form thereof, the present invention is directed to a muffler including a outer shell having an inlet end and an exhaust end. A pair of stampings are provided and form an assembly which includes a least three tubes extending between baffles. The assembly is received within the outer shell and therewith forms a first chamber between the inlet end and a baffle, a second chamber between the outlet end and a baffle and a central chamber between the baffles. An inlet tube extends through the inlet end and communicates with one of the assembly tubes. An outlet tube extends through the outlet end and communicates with another one of the assembly tubes. A plurality of openings are provided between at least one of the assembly tubes and the central chamber. The stampings are provided with an impression for thereby forming weep holes between the central chamber and the first and second chambers whereby water may travel between the central chamber and the first and second chambers. The assembly tube openings are louver shaped. Each of the stampings are identical to one another and include valley portions between semicircular portions. The stampings are located in mirror image relation with respect to one another with the valley portions of one stamping located adjacent the valley portions of another stamping and the semicircular portions of one stamping located adjacent to the semicircular portions of the other stamping thereby forming the assembly. A rivet assembly is provided at the valley portions for retaining the stampings together.

BRIEF DESCRIPTION OF THE DRAWINGS

The above-mentioned and other features and objects of this invention and the manner of obtaining them will become more apparent and the invention itself will be better understood by reference to the following description of embodiments of the invention taken in conjunction with the accompanying drawings wherein.

Corresponding reference characters indicate corresponding parts throughout the several views of the drawings.

Figure 1:
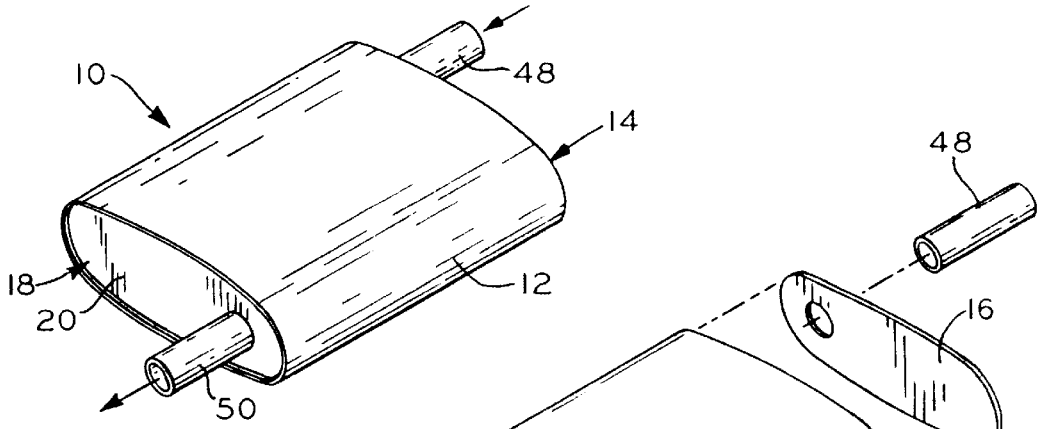
FIG. 1 is a perspective view of a muffler constructed in accordance with the principles of the present invention.

The exemplifications set out herein illustrate preferred embodiments of the invention in one form thereof and such exemplifications are not to be construed as limiting the scope of the disclosure or the scope of the invention in any manner.

DETAILED DESCRIPTION OF SPECIFIC EMBODIMENTS

Referring initially to FIGS. 1–4, there is shown a muffler generally depicted by the numeral 10 and having an outer shell 12 having a generally oval shape and defining an inlet end 14 closed off with an inlet end cap 16 and an outlet end 18 closed off with an outlet end cap 20. A stamping assembly generally depicted by the numeral 22 is constructed of two generally identical stampings or plates 24 located on top of one another and in mirror image relation with respect to one another. The stamping assembly 22 is received within the muffler outer shell 12 preferably centered or equidistant from each of the inlet and outlet ends 14 and 18.

Each of the stampings 24 include valley portions 26 between semicircular portions 28 such that when a set of stampings 24 are located in mirror image relation with respect to one another the valley portions 26 of one stamping are located adjacent the valley portions 26 of the other stamping and the semicircular portions 28 also located adjacent one another thereby forming three longitudinally extending tubes or openings 30. The stampings 24, at each longitudinal end thereof, are also provided with baffle portions 32 extending radially outwardly to a perimeter area 34 formed with an oval shape similar to the oval shape of the inner surface of outer shell 12. In this manner, when two stampings 24 are assembled to one another in a mirror image relation with respect to one another, baffles which are shown and generally depicted by the numeral 36 are formed having a cross-sectional shape and size so as to fit within the outer shell 12 as shown. Essentially, the perimeter areas 34 of portions 32 engage the inner wall of the outer shell 12 thereby dividing the muffler outer shell 12 into a first chamber 38 between the inlet end 14 or end cap 14 and a baffle 36 and a second chamber 40 between the outlet end 18 or end cap 20 and a baffle 36. The stampings 24 further include side edges 42 such that when the assembly 22 is received within the outer shell 12, the side edges 42 extend substantially to the inner wall of the stamping 12 thereby further dividing the central chamber located between the baffles 36 into an upper central chamber 44 and a lower central chamber 46.

An inlet tube 48 extends through a hole in inlet end cap 16 and communicates with one of the assembly tubes 30. An outlet tube 50 extends through a hole in the outlet end cap 20 and communicates with another one of the assembly tubes 30. Thus, in operation, exhaust gases entering the inlet tube 48 are directed past the first chamber 38 and through one of the assembly tubes 30 to the second chamber 40. As the outlet tube 50 communicates with and is blocking one of the assembly tubes 30, the exhaust gases are directed from the second chamber 40 through the remaining tube 30 (that tube not directly connected to either the inlet tube 48 or outlet tube 50) and back to the first chamber 38. At the first chamber 38 the exhaust gases then travel back through the tube 30 connected to or communicating with the outlet tube 50 thereby exiting the muffler 10. As more fully discussed hereinbelow, the stampings 24 and the assembly 22 are constructed in accordance with the principles of the present invention so as to resist corrosion and be generally long lasting and, further, so as to attenuate the sound from the exhaust engine generating the exhaust gases.

So as to resist corrosion of the muffler components as a result of the acidic condensation which accumulates within the muffler, the various components thereof including stampings 24, outer shell 12, end caps 16 and 20, and inlet and outlet pipes 48 and 50 are all preferably made of cold-rolled low carbon steel with an aluminized coating. Additionally, each of the stampings 24 are formed with an impression 52 in each of the perimeter areas 34 of baffle portions 32. The impressions, as shown, are formed by bending the metal thereat so as to form an elongate longitudinally extending channel in the perimeter areas 34 such that, when the assembly 22 is received within the outer shell 12, a weep hole generally depicted by the numeral 54 is formed between the inner wall of the outer shell 12 and the impression or channel 52. Thus, acidic condensation forming within either the upper or lower central chambers 44 or 46 may travel out through the weep holes 54 to either first or second chambers 38 or 40 and out of the muffler 10 through a hole in one of the end caps 16 or 20 (not shown) which is commonly used on all mufflers.

Figure 6:
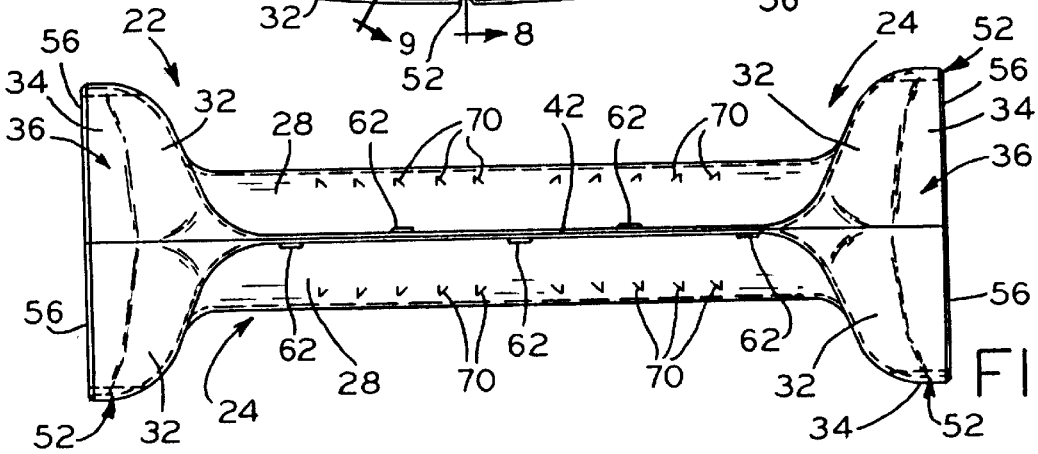
FIG. 6 is a side elevation view of the stamping assembly shown in FIG. 4.
Figure 3:
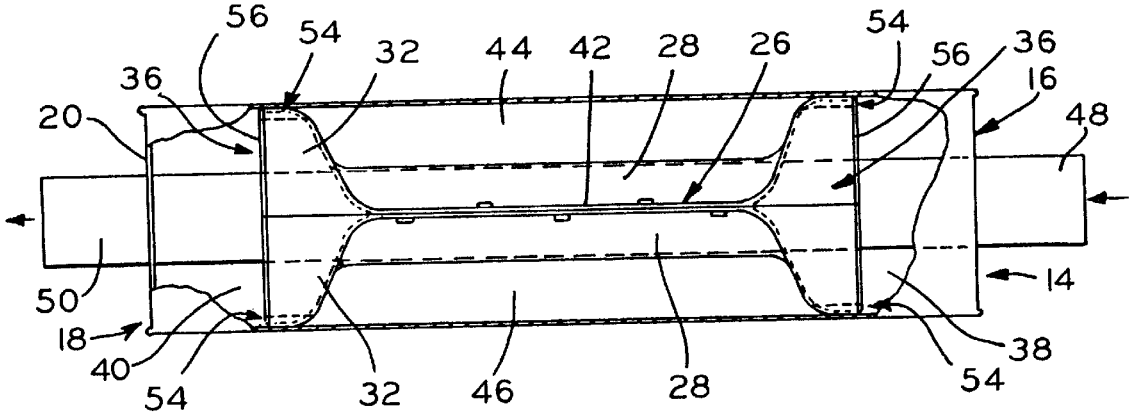
FIG. 3 is a side elevation view of the muffler shown in FIG. 1 with the outer shell cut away and showing the stamping assembly received therein.

As shown in the figures, the perimeter area 34 is provided with some width and does not end with an abrupt edge at the inner surface of the outer shell 12. Additionally, the impression 52 extends across the entire width of the perimeter area 34 and by merely bending the metal to form the channel, the aluminized coating of the cold-rolled sheet metal is retained. Thus, only the perimeter edge 56 whereat the stampings 24 have been cut are not covered with the corrosion resistant aluminized coating and only that perimeter edge is not protected from oxidation as a result of the acidic condensation. It is further noted that by providing the weep holes 54 at each of the baffles 36, the acidic condensation may also travel from either of the first and second chambers 38 and 40 across either of the upper or lower central chambers 44 and 46 to wherever the water exhaust port hole may be located at either the inlet or outlet end caps 16 or 18. As best seen in FIG. 6, the perimeter edge 56 of each of the stampings 24 is bent or "broken" radially inwardly. In this manner, when the stamping assembly 22 is "stuffed" or inserted longitudinally into the outer shell 12, the perimeter edge 56 is more readily located properly for sliding the stamping assembly 22 longitudinally into the outer shell 12.

Figure 2:
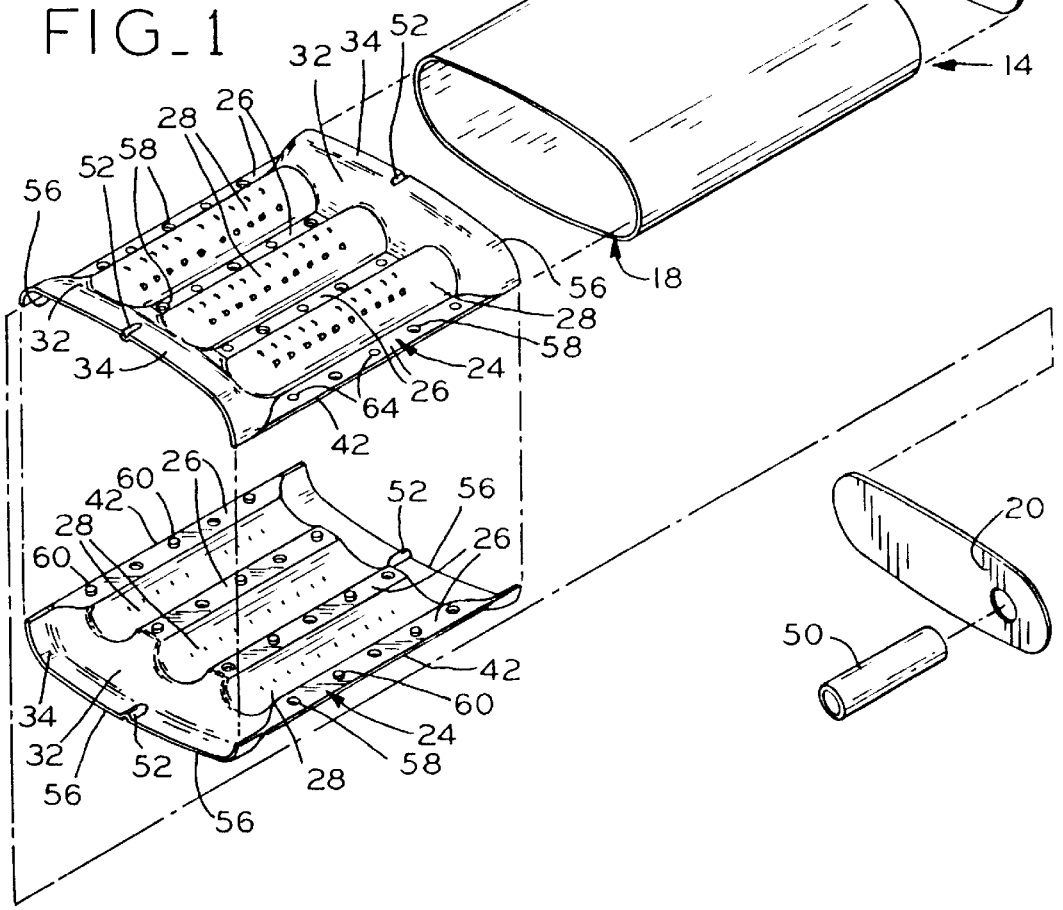
FIG. 2 is an exploded perspective view of the muffler shown in FIG. 1 generally showing the method of assembly of the various components thereof.
Figure 5:
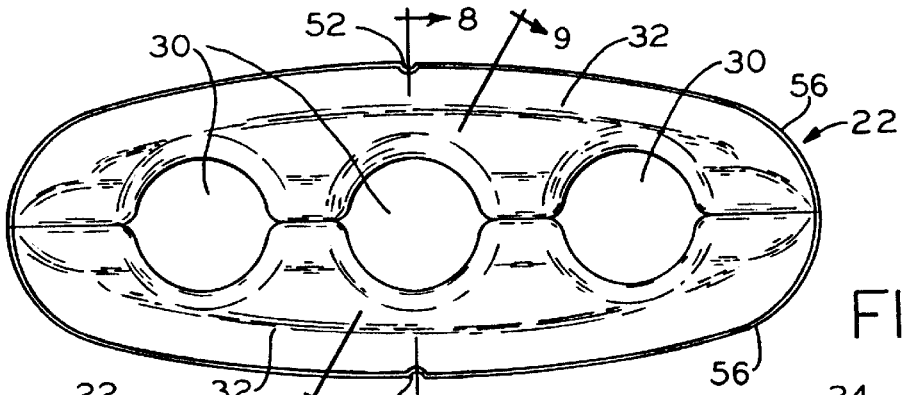
FIG. 5 is an end view of the stamping assembly shown in FIG. 4.
Figure 4:
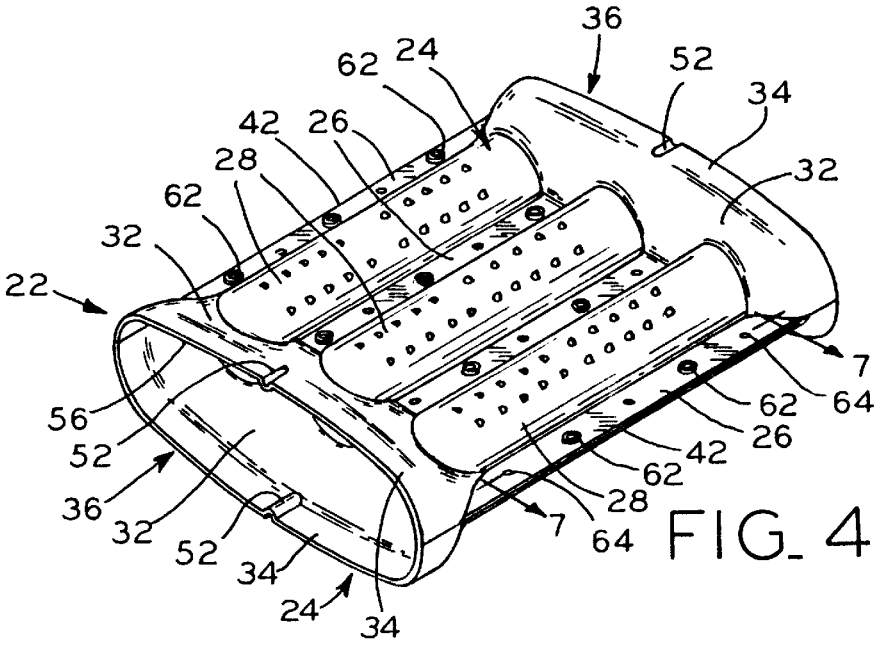
FIG. 4 is a perspective view of a stamping assembly constructed and assembled in accordance with the principles of the present invention.
Figure 7:
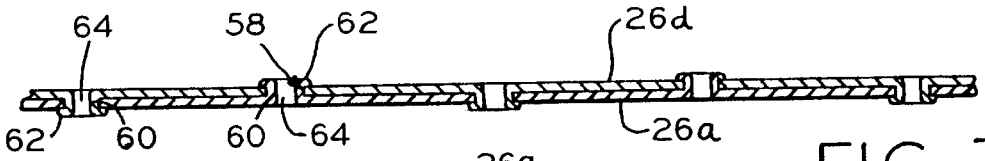
FIG. 7 is a cross-sectional view taken generally along line 7—7 in FIG. 4.
Figure 13:
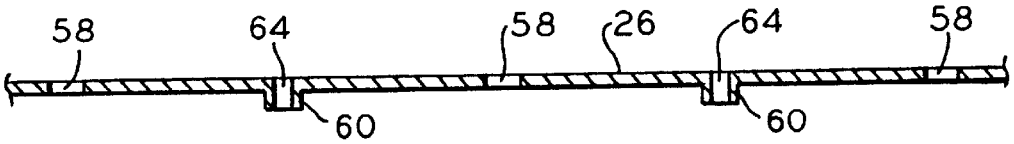
FIG. 13 is a cross-sectional view taken generally along line 13—13 of FIG. 10.

As best seen in FIGS. 4, 7, and 13, the stampings 24 are preferably attached or retained together by rivet assemblies via the same sheet metal material as that of the stampings themselves. In this regard, at each of the valley portions 26, the stampings 24 are provided with alternating rivet holes 58 and annular protrusions 60. The annular protrusions 60 extend vertically downwardly as seen in FIG. 13 and have an outer diameter slightly smaller than the diameter of the rivet holes 58. Additionally, the rivet holes 58 and annular protrusions 60 are located in the valley portions 26 in a pattern such that, when stampings 24 are located adjacent and in mirror image relation with respect to one another as depicted in FIGS. 2 and 4, the annular protrusions 60 of one stamping 24 are received through adjacent rivet holes 58 of the other stamping 24. This also essentially locates the stampings 24 so as to form the stamping assembly 22 as shown in FIG. 4. The annular protrusions 60 are thereafter stamped or otherwise deformed radially outwardly forming a rivet annular lip 62 so as to thereby retain the stampings 24 together. As seen in FIGS. 4 and 7, at each valley portion 26, preferably, there are a total of five rivet connections with the rivet annular lip 62 of each alternating in direction vertically upwardly and downwardly. In this manner, any acidic condensation that may accumulate in either the upper or lower central chambers 44 or 46 and regardless of the position of the muffler (right side or upside down) the acidic water readily flows through the holes 64 extending through the annular protrusions 60 and thereafter out of the upper and lower central chambers 44 and 46 through weep holes 54. As can be appreciated by alternating the location of the rivet annular lips 62 up and down, any acidic condensation is prevented from "puddling" or accumulating on the surface of the valley portions 26 by the height of the annular protrusions and lips 62. Further yet, the aluminized coating is, for the most part, retained and the carbon steel thereunder does not become exposed other than at the outermost perimeter edge of the annular protrusions 60 which form the annular lip 62. Nevertheless, because the rivet holes 58 are essentially wrapped by the metal forming the annular protrusion 60, the overall connection between the stampings 24 is solid and a substantial amount of corrosion must occur to deteriorate the metal forming the protrusion 60 and to thereby cause the stampings 24 to separate from one another.

Figure 10:
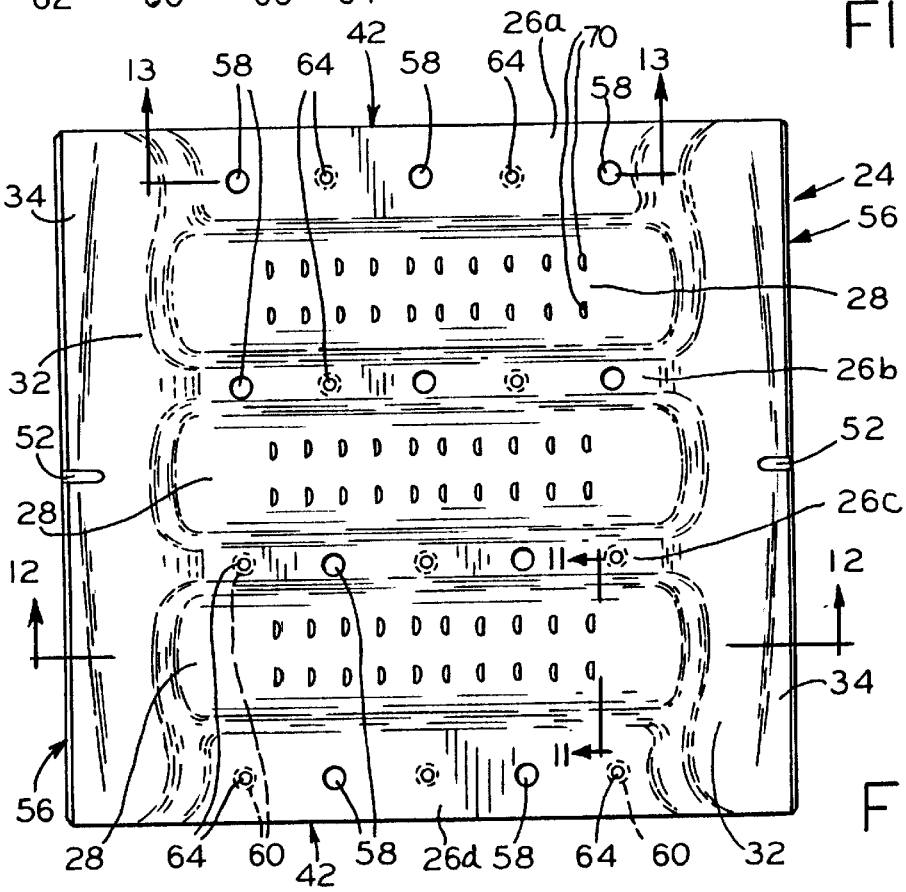
FIG. 10 is a top plan view of a stamping constructed in accordance with the principles of the present invention.
Figure 8:
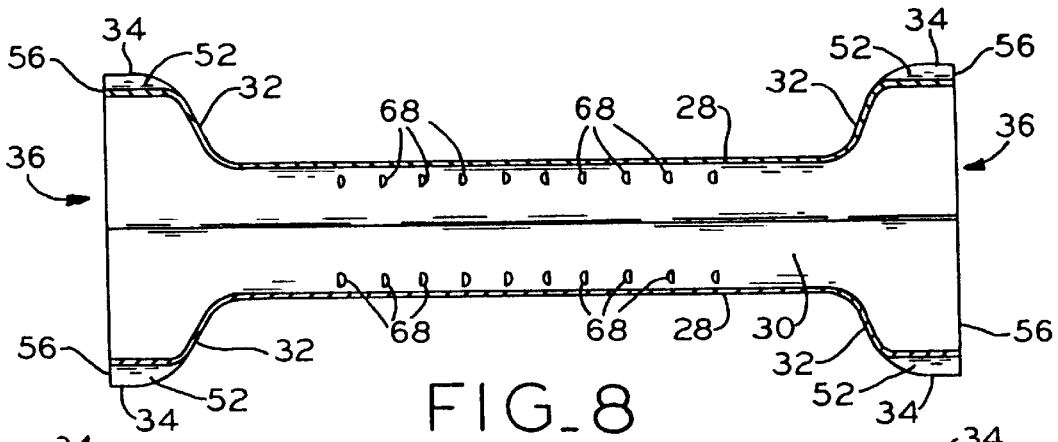
FIG. 8 is a cross-sectional view taken generally along line 8—8 in FIG. 5.

As best seen in FIG. 10, the pattern of alternating rivet holes 58 and annular protrusions 60 in the valley portions 26a and 26b preferably includes three rivet holes 58, two of which are located at the proximal ends of the valley portions near the baffle portions 32, and one of which is centrally located between the annular protrusions 60. This pattern is repeated in valley portions 26*c* and 26*d* except that the rivet holes 58 and annular protrusions 60 are reversed. In this manner, as also discussed hereinabove, when the stampings 24 are located in mirror image relation with respect to one another as depicted in FIGS. 2 and 4, the opposing annular protrusions 60 of each stamping 24 match the pattern of the rivet holes 58 of the opposing stamping so as to be received therein as shown in FIGS. 4 and 7. It is noted that the side edges 66 of each of the stampings 24 extend generally linearly and are located radially outwardly such that they come in contact with the inner wall of the outer shell 12. In this manner, the upper and lower central chambers 44 and 46 are better defined and separated from one another.

Figure 9:
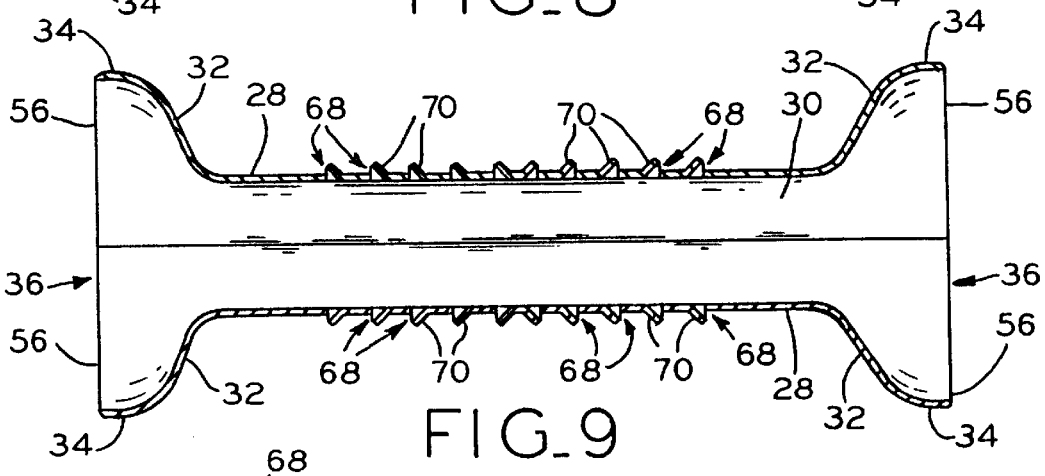
FIG. 9 is a cross-sectional view taken generally along line 9—9 in FIG. 5.
Figure 11:
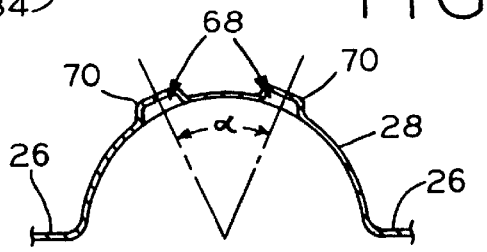
FIG. 11 is a cross-sectional view taken generally along line 11—11 of FIG. 10.
Figure 12:
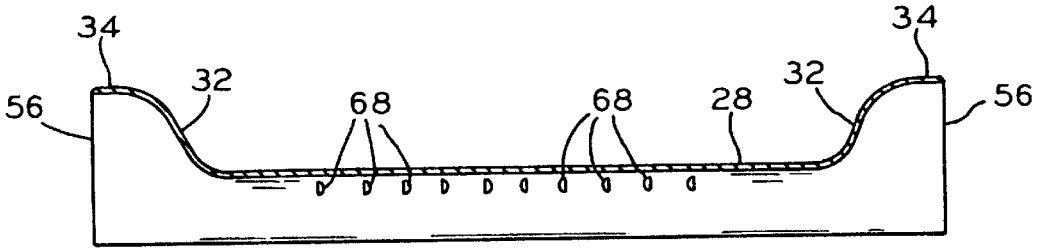
FIG. 12 is a cross-sectional view taken generally along line 12—12 of FIG. 10.

During use of muffler 10, exhaust gases, in general, do not flow through the upper and lower central chambers 44 and 46 but, rather, those chambers attenuate or otherwise decrease the apparent sound emitted by the exhaust engine. In this regard, a plurality of openings 68 are provided in each of the semi-circular portions 28 forming the tubes 30. These openings 68 provide communication between the flowing exhaust gases traveling through the tubes 30 and the upper and lower central chambers 44 and 46. Openings 68 are made by stamping a lance or louver-shape portion 70 of the metal radially outwardly as best seen in FIGS. 9 and 11 so as to thereby form louver-shaped openings 68 as shown. Preferably, two rows of ten louver-shaped openings 68 are provided on each of the semi-circular portions 28 as shown in FIG. 10, thereby providing a total of four rows and forty louver-shaped openings in each of the tubes 30. As best seen in FIG. 9, in each row of openings 68, five or one-half of the louver-shaped openings open longitudinally toward one of the baffle portions 32 whereas the other five or one-half of the louver-shaped openings 68 open longitudinally in the opposite direction or toward the other baffle portion 32. As best seen in FIG. 11, each of the rows of louver-shaped openings 68 are located at an angle $\alpha$ radially from each other about the central longitudinal axis of the tube 30. Preferably, angle $\alpha$ is about 20 to 70 degrees and no greater than about 45 degrees. Very importantly, because one-half of the louver-shaped openings open longitudinally opposite the direction of the other one-half of the louver-shaped openings, regardless of the direction of travel of the exhaust gases, the upper and lower central chambers 44 and 46 operate and attenuate the sound substantially identically. Thus, the inlet tube 48 and outlet tube 50 can be connected for communication with any one of the formed tubes 30 so long as a serpentine exhaust flow pattern is achieved and the muffler 10 will, nevertheless operate generally identically and regardless of how the operator may install the muffler 10. That is, the muffler can be installed upside down from the position shown in FIGS. 1 and 2 and will, nevertheless, operate the same. Indeed, muffler 10 could even be installed for directing the exhaust gases opposite the direction depicted by the arrows in FIG. 1 and muffler 10 will, nevertheless, operate substantially identically. As can be appreciated, this provides for a generally universal muffler capable of installation on many different vehicles and in different ways and locations. Further yet, it has been advantageously found that the louver-shaped openings 68 made by stamped lower shaped portions 70 as provided and as described hereinabove, provide attenuation in the upper and lower central chambers 44 and 46 sufficient for properly decreasing the apparent sound on many different exhaust engines and vehicles. Thus, muffler 10 can be used on many different exhaust engines and vehicles.

Figure 14:
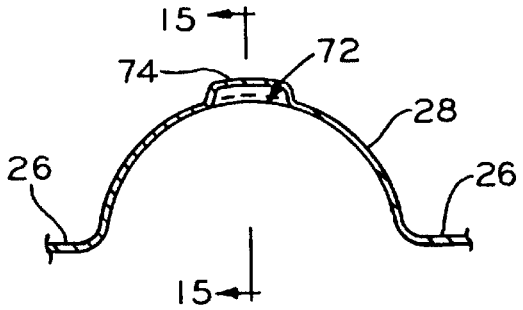
FIG. 14 is a cross-sectional view similar to FIG. 11 but depicting another embodiment of a second stamping in accordance with the principles of the present invention; and, FIG. 15 is a cross-sectional view taken generally along line 15—15 and depicting the second embodiment stamping assembly.
Figure 15:
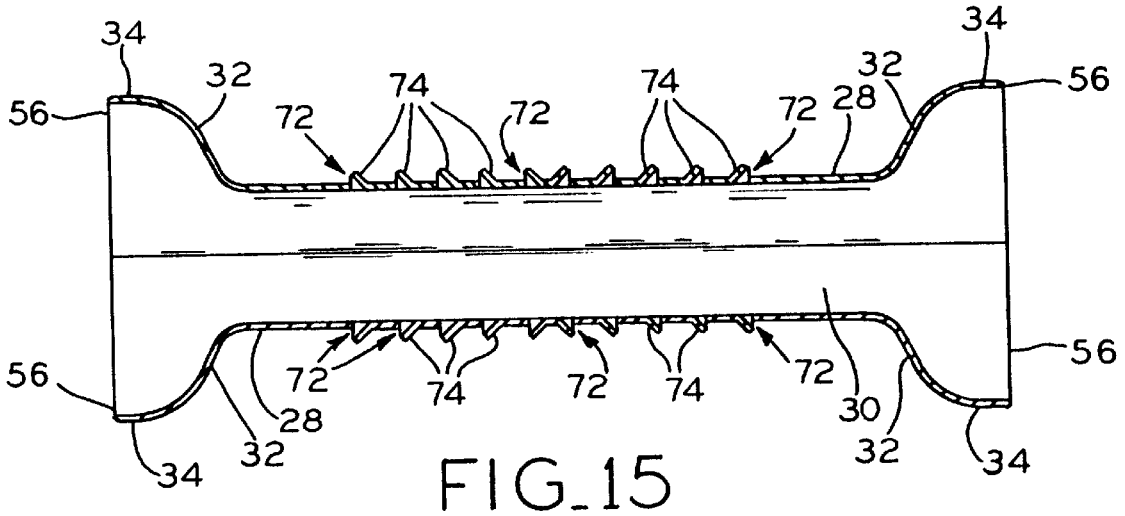

In another embodiment depicted in FIGS. 14 and 15, only a single row of ten louver-shaped openings 72 are provided at the apex of the semi-circular portions 28. These louver-shaped openings 72 are somewhat larger than those of the embodiment of FIGS. 1–13 and are 9 formed by stamping a lance or louver-shaped portion 74 of the semi-circular portions 28. As shown in FIG. 15, one-half or five of these louver-shaped openings 72 similarly open longitudinally toward one baffle portion 32 whereas the other one-half or five louver-shaped openings open in an opposite direction longitudinally toward the other baffle portion 32. In this embodiment, a total of twenty such openings 72 are thus provided in each of the tubes 30. Similarly, this design is also believed to be generally universal in nature for operation with various patterns of locations of the inlet and outlet tubes 48 ad 50 and for use with various different exhaust engines and vehicles.

While the invention has been described as having specific embodiments, it will be understood that it capable of further modifications. This application is, therefore, intended to cover any variations, uses or adaptations of the invention following the general principles thereof and including such departures from the present disclosure as come within known or customary practice in the art to which this invention pertains and fall within the limits of the appended claims.

What is claimed is:

1. A muffler comprising:

an outer shell having an inlet end and an exhaust end;

an pair of stampings forming an assembly including at least three tubes extending between baffles, said assembly received in said outer shell and therewith forming a first chamber between said inlet end and a baffle, a second chamber between said outlet end and a baffle, and a central chamber between said baffles;

an inlet tube extending through said inlet end and communicating with one of said assembly tubes;

an outlet tube extending through said outlet end and communicating with another one of said assembly tubes;

a plurality of openings between at least one said assembly tubes and said central chamber;

wherein said stampings are provided with impressions for thereby forming weep holes between said central chamber and said first and second chambers whereby condensate may travel between said central chamber and said first or second chambers; and, wherein said impressions are located on a perimeter area of said stampings whereby said weepholes are formed between said stampings perimeter areas and said outer shell.

2. The muffler of claim 1 wherein said pair of stampings are identical to one another and are located in mirror image relation with respect to one another for forming said assembly.

3. The muffler of claim 1 wherein said assembly extends to said outer shell dividing said central chamber into upper and lower central chambers.

4. The muffler of claim 3 wherein said impressions are located on said baffles and form weep holes between said upper central chamber and said first and second chambers and between said lower central chamber and said first and second chambers.

5. The muffler of claim 4 wherein said pair of stampings are identical to one another and are located in mirror image relation with respect to one another for forming said assembly.

6. The muffler of claim 3 wherein said pair of stampings are identical to one another and are located in mirror image relation with respect to one another for forming said assembly.

7. A muffler comprising:

an outer shell having an inlet end and an exhaust end;

a pair of stampings forming an assembly including at least three tubes extending between baffles, said assembly received in said outer shell and therewith forming a first chamber between said inlet end and a baffle, at second chamber between said outlet end and a baffle, and a central chamber between said baffles;

an inlet tube extending through said inlet end and communicating with one of said assembly tubes;

an outlet tube extending through said outlet end and communicating with another one of said assembly tubes;

a plurality of openings between at least one said assembly tubes and said central chamber; and, wherein said assembly tube openings are louver shaped, said louver shaped openings open in a direction generally parallel with said tubes, and at least one louver shaped opening opens in a direction generally opposite the direction of another louver opening.

8. The muffler of claim 7 wherein one-half of said louvers open generally longitudinally in one direction and the other one-half of said louvers open generally longitudinally in an opposite direction.

9. The muffler of claim 7 wherein a plurality of louver shaped openings are provided between each of said assembly tubes and said central chamber.

10. The muffler of claim 9 wherein said assembly extends to said outer shell dividing said central chamber into upper and lower central chambers and further wherein a plurality of louver shaped openings are provided between each of said assembly tubes and both said upper and lower central chambers.

11. The muffler of claim 10 wherein a group of louver shaped openings are provided between each assembly tube and said upper and lower central chambers, and wherein from each group at least one of said louver shaped openings open in a direction generally opposite the direction of another louver opening.

12. The muffler of claim 11 wherein each group of openings includes a row of louver openings and wherein one-half of said row of louvers open generally longitudinally in one direction and the other one-half of said row of louvers open generally longitudinally in the opposite direction.

13. The muffler of claim 12 wherein each group of openings includes a second row of louvers identical to the first and further wherein each group includes at least twenty louver shaped openings.

14. The muffler of claim 10 wherein a group of louver shaped openings are provided between each assembly tube and said upper and lower central chambers, each group including two rows of louver shaped openings extending longitudinally along said assembly tubes.

15. The muffler of claim 14 wherein one-half of said rows of louvers open longitudinally general in one direction and the other one-half of said rows of louvers open generally longitudinally in the opposite direction.

16. The muffler of claim 14 wherein said first and second rows are located less than forty-five degrees radially from each other about said assembly tubes.

17. A muffler comprising:

an outer shell having an inlet end and an exhaust end;

a pair of stampings forming an assembly including at least three tubes extending between baffles, said assembly received in said outer shell and therewith forming a first chamber between said inlet end and a baffle, at second chamber between said outlet end and a baffle, and a central chamber between said baffles;

an inlet tube extending through said inlet end and communicating with one of said assembly tubes;

an outlet tube extending through said outlet end and communicating with another one of said assembly tubes;

a plurality of openings between at least one said assembly tubes and said central chamber;

wherein each of said stampings are identical to one another and include valley portions between semicircular portions, said pair of stampings being located in mirror image relation with respect to one another with said valley portions of one stamping located adjacent the valley portions of the other stamping and the semicircular portions of one stamping located adjacent the semicircular portions of the other stamping thereby forming said assembly;

wherein said rivet means are provided at said valley portions for retaining said stampings together; and, wherein said rivet means includes alternating rivet holes and annular protrusions in each stamping valley portion, said annular protrusions of one stamping adapted to be received in said rivet holes of the other stamping when located in said mirror image relation with respect to one another, said annular protrusions being deformable radially outwardly whereby said stampings are retained together.

18. The muffler of claim 17 wherein said assembly extends to said outer shell dividing said central chamber into upper and lower central chambers.

19. The muffler of claim 17 wherein said stampings are provided with impressions for thereby forming weep holes between said central chamber and said first and second chambers whereby condensate may travel between said central chamber and said first or second chambers.

20. The muffler of claim 19 wherein said assembly tube openings are louver shaped.

21. The muffler of claim 20 wherein a plurality of louver shaped openings are provided between each of said assembly tubes and said central chamber.

22. The muffler of claim 19 wherein said impressions are located on a perimeter area of said stampings whereby said weep holes are formed between said stampings perimeter areas and said outer shell.

23. The muffler of claim 22 wherein said assembly tube openings are louver shaped.

24. The muffler of claim 23 wherein a plurality of louver shaped openings are provided between each of said assembly tubes and said central chamber.

* * * * *